US010098467B2

(12) United States Patent
Bayiokos

(10) Patent No.: US 10,098,467 B2
(45) Date of Patent: Oct. 16, 2018

(54) DEPLOYABLE ARM SUPPORT SEATING ASSEMBLY

(71) Applicant: Peter Bayiokos, Staten Island, NY (US)

(72) Inventor: Peter Bayiokos, Staten Island, NY (US)

( * ) Notice: Subject to any disclaimer, the term of this patent is extended or adjusted under 35 U.S.C. 154(b) by 0 days.

(21) Appl. No.: 15/454,777

(22) Filed: Mar. 9, 2017

(65) Prior Publication Data

US 2018/0255933 A1 Sep. 13, 2018

(51) Int. Cl.

| | |
|---|---|
| ***A47C 7/54*** | (2006.01) |
| ***A47C 1/03*** | (2006.01) |
| ***A47C 1/14*** | (2006.01) |
| ***A47C 4/28*** | (2006.01) |

(52) U.S. Cl.

CPC ..... *A47C 7/543* (2013.01); *A47C 1/03* (2013.01); *A47C 1/143* (2013.01); *A47C 4/28* (2013.01)

(58) Field of Classification Search

CPC .. A47C 1/03; A47C 1/14; A47C 1/143; A47C 4/00; A47C 4/04; A47C 4/28; A47C 4/52; A47C 7/54; A47C 7/543

See application file for complete search history.

(56) References Cited

U.S. PATENT DOCUMENTS

| | | | | |
|---|---|---|---|---|
| 3,550,958 | A * | 12/1970 | Krein | A47C 7/543 297/403 |
| D338,782 | S | 8/1993 | Gibson et al. | |
| 6,158,069 | A * | 12/2000 | Boothe | A47C 7/54 5/623 |
| 7,832,804 | B2 | 11/2010 | LaFrenierer | |
| 8,585,135 | B2 | 11/2013 | Wilson | |
| 9,039,077 | B1 * | 5/2015 | Santamaria | A47C 1/146 297/31 |
| 2006/0076818 | A1 * | 4/2006 | LaFreniere | A47C 7/543 297/411.36 |
| 2007/0158986 | A1 | 7/2007 | Adams et al. | |
| 2008/0203802 | A1 * | 8/2008 | LaFreniere | A47C 1/03 297/411.35 |
| 2012/0098302 | A1 * | 4/2012 | Place | A47C 1/143 297/184.1 |
| 2014/0132041 | A1 * | 5/2014 | Manus | A47C 4/44 297/119 |
| 2016/0037935 | A1 * | 2/2016 | Piccioni | A47C 1/143 5/646 |

FOREIGN PATENT DOCUMENTS

| | | |
|---|---|---|
| WO | WO0247514 | 6/2002 |
| WO | WO2014078460 | 5/2014 |

* cited by examiner

*Primary Examiner* — Ryan D Kwiecinski

(57) ABSTRACT

A deployable arm support seating assembly for provision of arm support to a relining user includes a chair that has a back. The back is reclining. A pair of rests is rotatably coupled to opposing sides of the back of the chair. The rests are positioned between a top and a bottom of the back. Each rest is positioned on a respective opposing side of the back such that the rest is configured to be rotated to a position transverse to the respective opposing side. The rest is configured to support an arm of a user positioned in the chair with the back in a reclined position.

11 Claims, 4 Drawing Sheets

DEPLOYABLE ARM SUPPORT SEATING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to seating assemblies and more particularly pertains to a new seating assembly for provision of arm support to a relining user.

BRIEF SUMMARY OF THE INVENTION

An embodiment of the disclosure meets the needs presented above by generally comprising a chair that has a back. The back is reclining. A pair of rests is rotatably coupled to opposing sides of the back of the chair. The rests are positioned between a top and a bottom of the back. Each rest is positioned on a respective opposing side of the back such that the rest is configured to be rotated to a position transverse to the respective opposing side. The rest is configured to support an arm of a user positioned in the chair with the back in a reclined position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
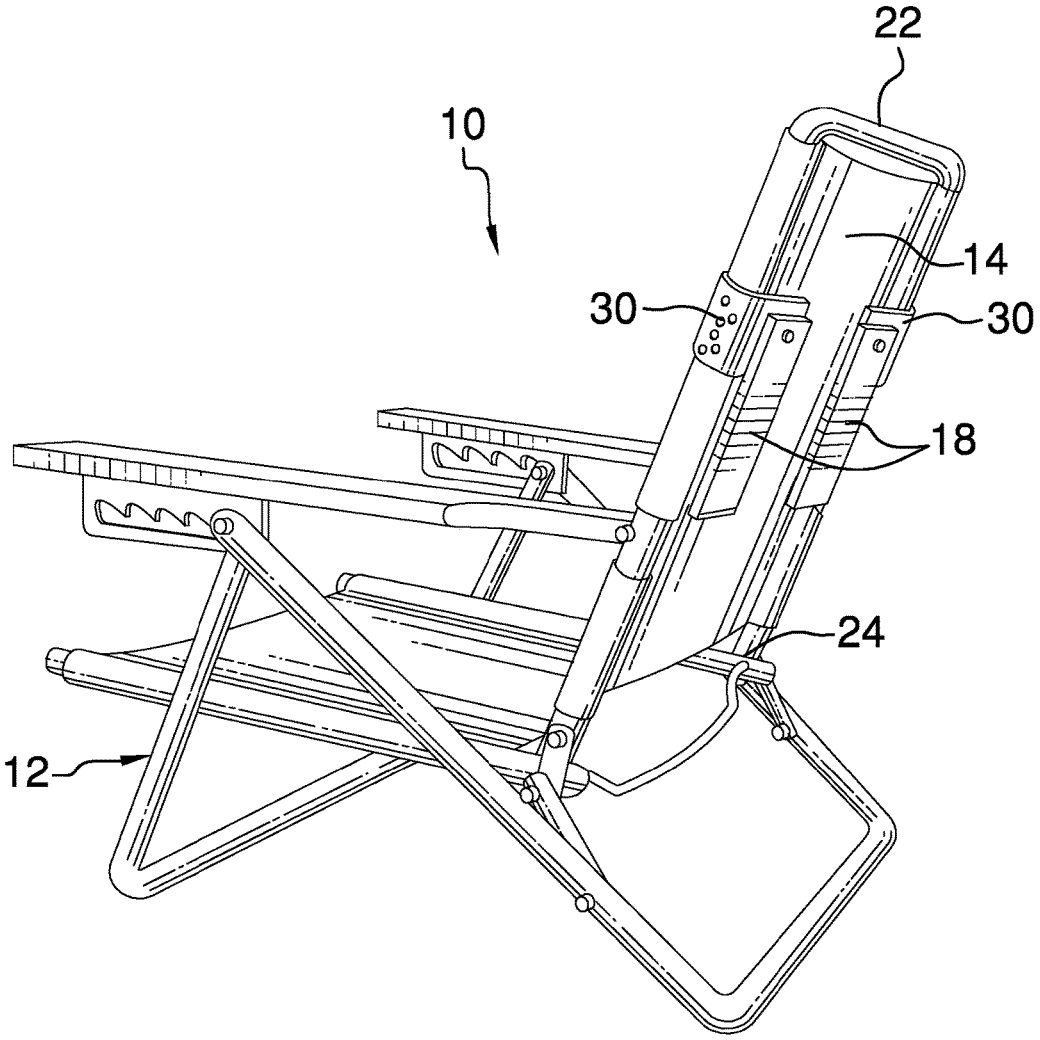
FIG. 1 is an isometric perspective view of a deployable arm support seating assembly according to an embodiment of the disclosure.
Figure 2:
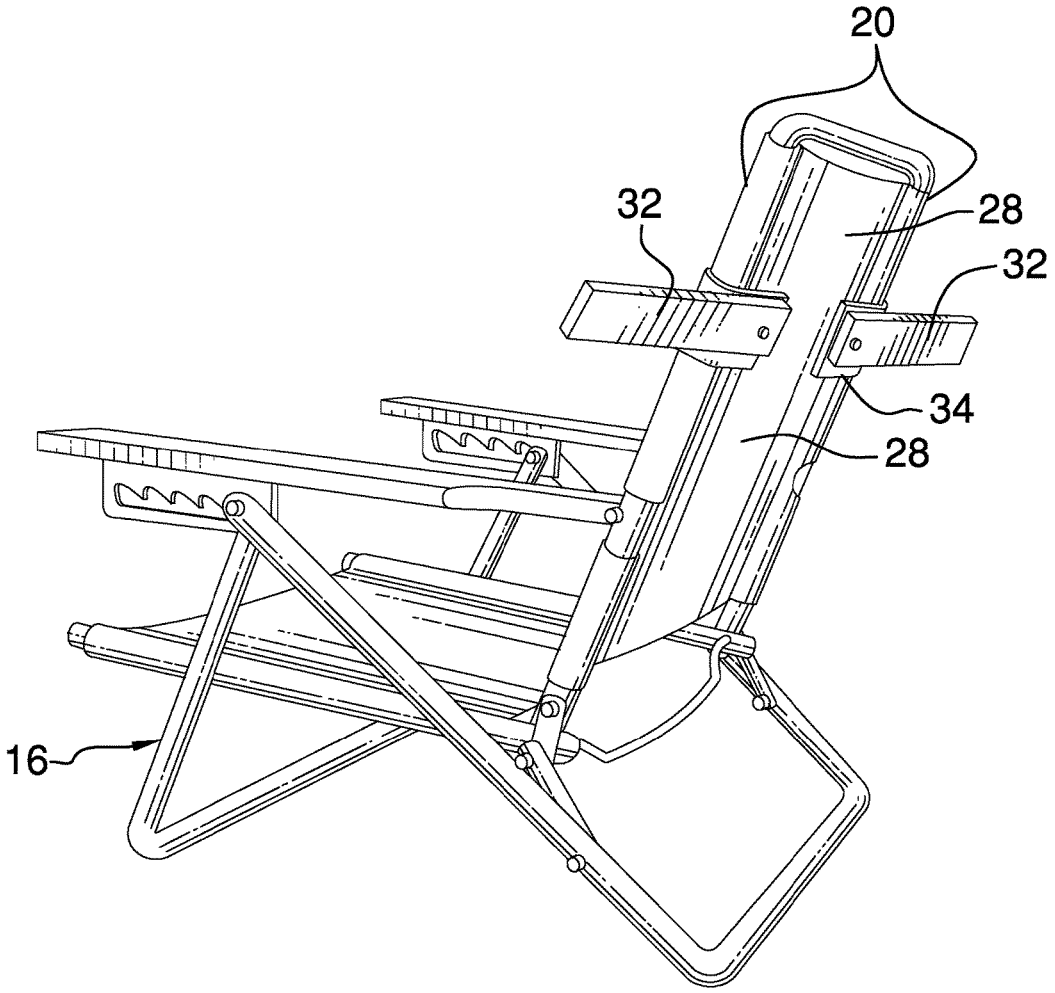
FIG. 2 is an isometric perspective view of an embodiment of the disclosure.
Figure 3:
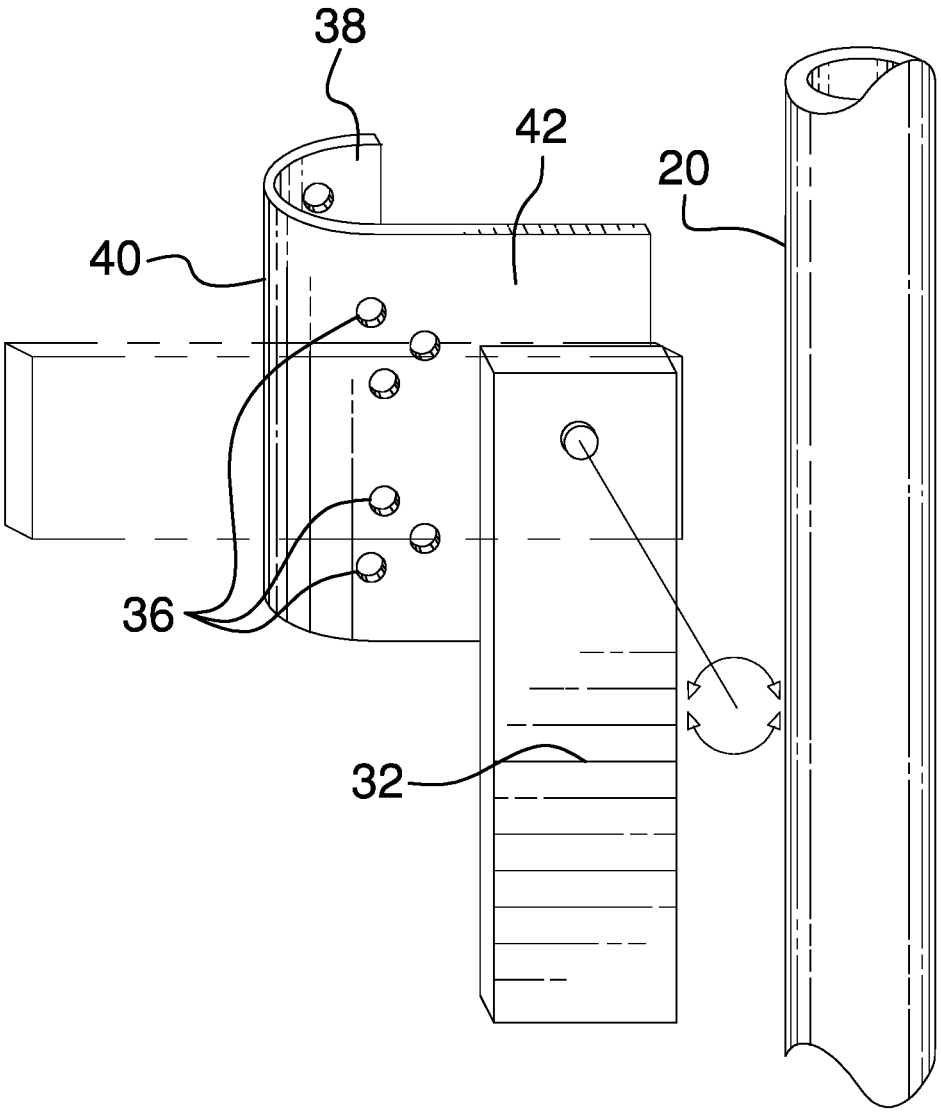
FIG. 3 is a detail view of an embodiment of the disclosure.
Figure 4:
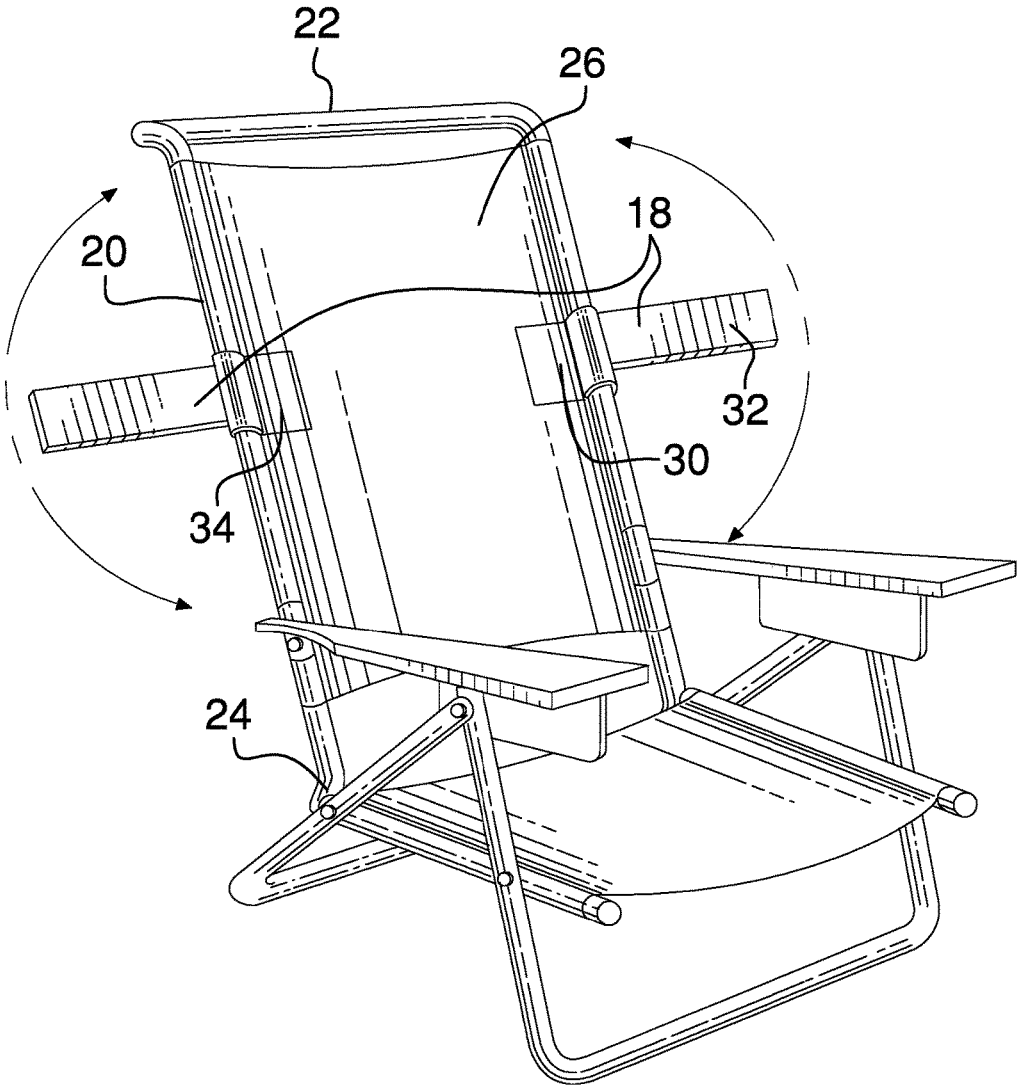
FIG. 4 is an isometric perspective view of an embodiment of the disclosure.

With reference now to the drawings, and in particular to FIGS. 1 through 4 thereof, a new seating assembly embodying the principles and concepts of an embodiment of the disclosure and generally designated by the reference numeral 10 will be described.

As best illustrated in FIGS. 1 through 4, the deployable arm support seating assembly 10 generally comprises a chair 12 that has a back 14. The back 14 is reclining. In one embodiment, the chair 12 is foldable. In another embodiment, the chair 12 comprises a lounge chair 16.

A pair of rests 18 is rotatably and singly coupled to opposing sides 20 of the back 14 of the chair 12. The rests 18 are positioned between a top 22 and a bottom 24 of the back 14. In one embodiment, the rests 18 are positioned on a front 26 of the back 14. In another embodiment, the rests 18 are positioned on a rear 28 of the back 14. In yet another embodiment, the rests 18 are padded.

Each rest 18 comprises a bracket 30 and a plank 32. The bracket 30 is configured to couple to a respective opposing side 20 of the back 14. The bracket 30 comprises a plate 34 and a plurality of penetrations 36. The plate 34 is curved such that a first portion 38 of the plate 34 extends from a center portion 40 of the plate 34 in the same direction as, and in substantial parallelism with, a second portion 42 of the plate 34. The second portion 42 of the plate 34 is dimensionally longer than the first portion 38. The penetrations 36 are positioned in the plate 34 such that the penetrations 36 are configured to couple the plate 34 to the respective opposing side 20.

The plank 32 is rotationally coupled to the bracket 30. In one embodiment, the plank 32 is coupled to the second portion 42 of the plate 34. The plank 32 is substantially rectangularly shaped. In one embodiment, the plank 32 extends from twenty to sixty centimeters from the respective opposing side 20 when the plank 32 is rotated to a position perpendicular from the respective opposing side 20. In another embodiment, the plank 32 extends from thirty to fifty centimeters from the respective opposing side 20 when the plank 32 is rotated to a position perpendicular from the respective opposing side 20. In yet another embodiment, the plank 32 extends from thirty five to forty five centimeters from the respective opposing side 20 when the plank 32 is rotated to a position perpendicular from the respective opposing side 20.

In use, the bracket 30 is couplable to the respective opposing side 20, such that the plank 32 is configured to rotate from a stowed position substantially parallel to the respective opposing side 20 to a deployed position transverse to the respective opposing side 20. Each rest 18 is positioned on the back 14 such that the rest 18 is configured to support an arm of a user positioned in the chair 12 with the back 14 in a reclined position. The rests 18 allow a user positioned in the chair 12 to comfortably tan an underside of the arm positioned on the rest 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A deployable arm support seating assembly comprising:

a chair having a back, said back being reclining;

a pair of rests rotatably and singly coupled to opposing sides of said back of said chair, said pair of rests being positioned between a top and a bottom of said back, each said rest comprising a bracket coupled to a respective said opposing side of said back, a plank rotationally coupled to said bracket, said bracket comprising a plate, said plate being curved such that a first portion of said plate extends in substantial parallelism with a second portion of said plate, said second portion of said plate being dimensionally longer than said first portion, and a plurality of penetrations positioned in said plate, wherein said penetrations are positioned in said plate such that said penetrations are configured for coupling of said plate to said respective said opposing side; and said plank being coupled to said second portion of said plate, and wherein said bracket is coupled to said respective said opposing side such that said plank is configured for rotation from a stowed position substantially parallel to said respective said opposing side to a deployed position transverse to said respective said opposing side;

wherein said pair of rests are configured to support an arm of a user positioned in said chair with said back in a reclined position.

2. The assembly of claim 1, further including said chair being foldable.

3. The assembly of claim 1, further including said chair comprising a lounge chair.

4. The assembly of claim 1, further including said pair of rests being positioned on a front of said back.

5. The assembly of claim 1, further including said pair of rests being positioned on a rear of said back.

6. The assembly of claim 1, further including said pair of rests being padded.

7. The assembly of claim 1, further including said plank being substantially rectangularly shaped.

8. The assembly of claim 1, further including said plank extending from twenty to sixty centimeters from said respective said opposing side when said plank is rotated to a position perpendicular from said respective said opposing side.

9. The assembly of claim 8, further including said plank extending from thirty to fifty centimeters from said respective said opposing side when said plank is rotated to a position perpendicular from said respective said opposing side.

10. The assembly of claim 9, further including said plank extending from thirty five to forty five centimeters from said respective said opposing side when said plank is rotated to a position perpendicular from said respective said opposing side.

11. A deployable arm support seating assembly comprising:

a chair having a back, said back being reclining, said chair being foldable, said chair comprising a lounge chair;

a pair of rests rotatably and singly coupled to opposing sides of said back of said chair, said pair of rests being positioned between a top and a bottom of said back, said pair of rests being positioned on a front of said back, said rests being positioned on a rear of said back, said rests being padded, each said rest comprising:

a bracket coupled to a respective said opposing side of said back, said bracket comprising:

a plate, said plate being curved such that a first portion of said plate extends in substantial parallelism with a second portion of said plate, said second portion of said plate being dimensionally longer than said first portion, and a plurality of penetrations positioned in said plate, wherein said penetrations are positioned in said plate such that said penetrations are configured for coupling of said plate to said respective said opposing side, a plank rotationally coupled to said bracket, said plank being coupled to said second portion of said plate, said plank being substantially rectangularly shaped, said plank extending from twenty to sixty centimeters from said respective said opposing side when said plank is rotated to a position perpendicular from said respective said opposing side, and wherein said bracket is coupled to said respective said opposing side such that said plank is configured for rotation from a stowed position substantially parallel to said respective said opposing side to a deployed position transverse to said respective said opposing side;

wherein said pair of rests are configured to support an arm of a user positioned in said chair with said back in a reclined position.

* * * * *